United States Patent [19]

Girtz

[11] 4,365,925

[45] Dec. 28, 1982

[54] MANHOLE COVER LIFTER

[76] Inventor: Sylvester A. Girtz, 8332 - 32nd Ave. North, Crystal, Minn. 55428

[21] Appl. No.: 172,668

[22] Filed: Jul. 28, 1980

[51] Int. Cl.[3] ..... B66F 11/00

[52] U.S. Cl. ..... 414/684.3; 254/131; 280/47.27; 294/91

[58] Field of Search ..... 414/684.3; 254/8 R, 254/120, 121, 123, 131.5, 131, 132; 294/91, 17; 280/47.27

[56] References Cited

U.S. PATENT DOCUMENTS

| | | | |
|---|---|---|---|
| 421,649 | 2/1890 | Annin | 280/47.27 |
| 3,157,411 | 11/1964 | Rhodes | 254/120 X |
| 3,666,285 | 5/1972 | Fertig | 280/47.27 X |
| 3,978,607 | 9/1976 | Piere | 294/91 X |
| 4,157,810 | 6/1979 | Haller et al. | 254/131 |

OTHER PUBLICATIONS

"Popular Mechanics;" Dec. 15, 1953; Hand Truck Equipped With Crane Lifts Heavy Loads.

*Primary Examiner*—Robert J. Spar
*Assistant Examiner*—Terry Flower
*Attorney, Agent, or Firm*—H. Dale Palmatier

[57] ABSTRACT

A manhole cover lifter comprising an elongate inclined lever with a handle at its upper end and a fastener at its lower end for attaching to the cover of a manhole; a depending strut intermediate the ends of the lever and a pair of wheels mounted at the lower end of the strut and on a transverse axis forming a fulcrum for the lifting lever; a lifter bar connecting the wheel axle with the forward end of the lifter bar, the lifting lever being of tubular steel and a stiffener bar in the tubular lever at the upper end of the depending strut; and a handle at the upper end of the lifting lever.

1 Claim, 5 Drawing Figures

10
11
11.1
12
13
13.1
14
15
16
17
18
19
20
21
22
22.1
23
24
25
26
27
28
28.1
29
C
C.1
P
R

MANHOLE COVER LIFTER

This invention relates to a device for lifting manhole covers from their seats in a road or at the ground surface.

BACKGROUND OF THE INVENTION

Manhole covers are known to be usually made of cast iron and often times they are of substantial size and weight and they are difficult to handle. Manhole covers are used to cover manholes which lead from street level down to a sewer or other utility device. Usually such manhole covers are very firmly seated in their seats at ground level or at the level of the roadway so that the manhole cover will not wobble and make noise when a vehicle drives over it. Often times some additional sealing material such as tar will be used in sealing the manhole cover in its desired location.

Accordingly, manhole covers are extremely difficult to lift in many instances and even where the manhole cover is reasonably loose in its seat, the manhole cover is certainly an object of substantial weight and odd dimensions as to make it difficult to lift and handle.

In the past, it has been common practice to lift a manhole cover slightly with a pick ax, and after the manhole cover has been lifted slightly and tilted up, the edge of the manhole cover is manually grasped and the cover is lifted additionally and then rolled out of the way. Of course, after the manhole cover has been rolled off to the side, it must be lowered to the ground or pavement again, and in order to prevent breaking the cast iron, the manhole cover must be actually lowered to the ground instead of allowed to simply fall over.

In using a pick ax, there is generally found a hole in the center of the circular manhole cover which will accommodate the point of a pick ax. The point of the pick ax will be inserted into the hole at the center of the manhole cover and then the ax handle will be lifted manually so as to tip the manhole cover upwardly and outwardly of its seat. Because of the difficulty in lifting manhole covers and in loosening them and moving them out of the way, workmen have experienced an unusual number of back injuries in doing this work. Also there is a propensity to injure the workman's hands or fingers as the manhole cover is handled, and especially as the manhole cover is laid down on the pavement next to the opening or as the manhole cover is replaced onto its seat in the opening.

SUMMARY OF THE INVENTION

An object of the invention is to provide a new and improved apparatus for handling a manhole cover.

Another object of the invention is to provide a novel apparatus for easily lifting a manhole cover in order to open the manhole, and then transport the manhole cover a short distance to an out of the way position.

Still another object of the invention is to provide an improved manhole cover lifting and manipulating aparatus which provides for safely handling the manhole cover to minimize the likelihood of a personal injury to the workmen during manipulating the manhole cover.

A feature of the present invention is a lifting lever with transport wheels providing the fulcrum and a readily detachable fastener for attaching the end of the lifting lever to the manhole cover to be lifted.

Another feature of the invention is the provision of an elongate lifting lever primarily of steel tubing with a depending strut at the wheeled fulcrum, the tubing having a steel bar confined and concealed therein adjacent the depending strut to absorb the bending force applied to the lever from the strut as the lever end of the lever lifts the manhole cover.

Still another feature of the invention is the provision of alternate fasteners for attaching to various forms of manhole covers which have through holes at the center of lifting recesses at the periphery; and the provision of an upstanding handle at one end of the lever and a depending foot beneath the handle to hold the lever above the ground surface as the handle is swung downwardly during lifting of the manhole cover.

An advantage of the invention is that the manhole cover lifter will make the job of lifting a manhole cover safer and easier by providing an upward lift with downward manual pressure on the lever, thereby minimizing likelihood of back injury to the workmen, the manhole cover lifter minimizes the need to manually grasp the heavy manhole cover by facilitating ready transport of the cover away from the opening from which the cover is removed. Another advantage is that the device is lightweight but is adequate in strength to perform the purpose intended, so as to be readily transportable on a light truck as part of a tool kit.

BRIEF DESCRIPTION OF DRAWINGS

FIG. 1 is a perspective view of the invention showing the use thereof.

DETAILED SPECIFICATION

Figures 2, 3, 4, 5, 7:
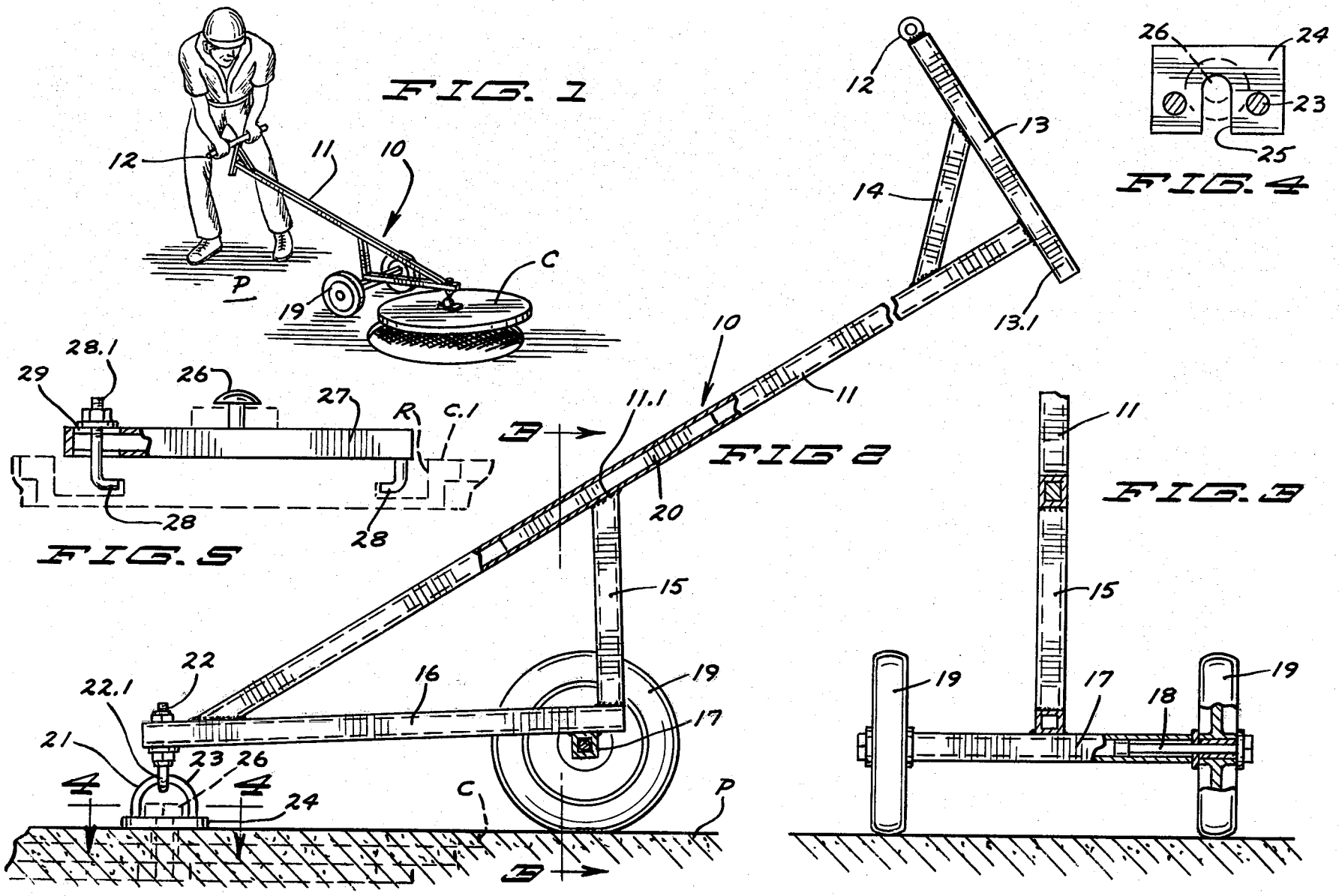
FIG. 2 is a side elevation view of the invention, a portion therefore being broken away to facilitate illustration at a larger scale.
FIG. 3 is a detailed section view taken approximately at 3—3 in FIG. 2.
FIG. 4 is an elevation view of an alternate form of attachment device.
FIG. 5 is an enlarged detail section view taken approximately at 5—5 in FIG. 2.

One form of the invention is shown in the drawings and is described herein. The manhole cover lifting device is indicated in general by numeral 10 and includes an elongate rigid lever 11 constructed of rigid steel tubing. The lever 11 is normally inclined as illustrated in FIGS. 1 and 2. A transverse handle 12 is secured to the upper end of the lever by a rigid frame element 13 which is welded to both the handle 12 and the upper end of the lever 11. A suitable brace 14 rigidifies the upright frame element 13 relative to the lever. The lower end portion 13.1 of the frame element defines a foot to continuously maintain the upper end portion of the lever 11 off the ground or pavement P so that the workman's hands will not be allowed to engage the ground as he bears down on the handle 12 or lever 11.

The lifting device includes a depending rigid strut 15 in upright position and having its upper end affixed as by welding to an intermediate portion of the rigid lever 11.

The lower end of the strut 15 is affixed by welding to the rear end of a substantially horizontal and rigid lifter bar 16 which extends forwardly to the lower end of the lever 11. The forward ends of the lever 11 and lifter bar 16 are welded together.

An elongate rigid axle tube 7 is affixed as by welding at the lower side of the lifter bar 16, and extends transversely of the lifter bar 16 and the lever 11. Axles 18 are mounted in the axle tube 17 and carry wheels 19 at the opposite ends of the axle tube to revolve on a horizontal axis extending transversely of both the strut 15 and lever 11. The wheels 19 provide the fulcrum for the lifting lever 11.

An elongate rigid steel insert bar 20 is confined and concealed within the steel tubing of lever 11 and the insert bar is located at the depending strut 15. The insert bar 20 is affixed at a predetermined location in the lever 11 so that portions of the insert bar extend in both directions upwardly and downwardly from the location of the strut 15. The steel insert bar 20 is affixed at a predetermined location in the tubing of lever 11 by welding the tubing 11 and the bar together at a drilled aperture 11.1 adjacent the depending strut 15. The welding affixes the insert bar at a predetermined location so as to absorb the bending force exerted upwardly on the lever 11 by the strut 15 when the lifting device is in use.

A fastening device 21 is secured to the front ends of the lever 11 and lifting bar 16 for attaching the forward or lower end of the lever to the manhole cover C. An eye-bolt 22 is affixed to the front end of the lifter bar 16 and a bail 23 is suspended from the loop 22.1 of the eye-bolt. A horizontal lifting plate 24 is suspended by the bail 23, and has an elongate slot 25 extending inwardly from one edge thereof for receiving a headed stud 26 which may be secured to the manhole cover C in one of a number of ways. In FIG. 2, the headed stud 26 is seen extending through a hole at the center of the manhole cover C and in this form the headed stud will be threaded for attachment to the cover by a nut so that the stud 26 remains with the cover at all times and need merely be lifted up slightly in order to slip the plate 24 beneath the head thereof.

In FIG. 5, the headed stud 26 is affixed as by welding to an elongate rigid bar 27 which spans across substantially the diameter of the manhole cover C.1 which in this form has deep recesses R therein for receiving depending hook-like protrusions 28 at the lower side of bar 27. One of the hook-like protrusions 28 is on an adjustable lug 28.1 movable in elongate slot 29 in the bar 27 in order to adjust the hooks relative to each other along the length of the bar so as to firmly grip the manhole cover C.1.

It will be recognized that in the use of this manhole cover lifter, the fastening device 21 is initially secured to the manhole cover by slipping the plate 24 around the stud and beneath the end thereof. The wheels 19 of the lifter will be placed adjacent the periphery of the manhole cover so that they are supported on the pavement P. Downward manual pressure on the handle 12 will cause the cover to be uplifted in the manner illustrated in FIG. 1. Because the workman is pressing downwardly on the handle 12, there is less likelihood of back injury to the workman than if he were lifting upwardly as on the handle of a pick ax in the old style.

As downward pressure is applied on the handle 12 for lifting the cover C out of the manhole opening, a very substantial bending force is supplied by the upward force of strut 15 against the lever 11. The force exerted upwardly against the lever 11 by the strut 15 is absorbed by the rigid steel insert bar 20 so as to minimize any likelihood that the lever 11 will be bent. However, the main portion of the lever 11, adjacent at opposite ends may be of reasonably light steel tubing without fear that it will bend. This lightness facilitates ready and easy handling of the lifting device 10 and transport thereof in a workman's truck as a part of his tool kit.

It will be recognized that after the cover C is loosened and lifted, it may be wheeled off to the side of the opening and then set down on the pavement again. There is no need for the workman to handle the cover C with his hands at all. If the upper end of the lever 11 is swung downwardly to the surface of the pavement P, the workman's hands are protected by the foot 13.1 which will engage the surface of the pavement first and prevent the lever 11 or the workman's hands from engaging the surface of the pavement.

When work in the manhole has been completed, the lifting device can lift the manhole cover again off the pavement and manipulate the cover back over the manhole opening and lower the cover into the opening in its usual position. The fastener 21 is removed from the stud, simply by lowering the manhole cover until strain is relieved from the fastener, and then the plate 24 is simply slipped off the stud.

If the manhole cover has recesses R at its periphery, instead of a hole at its center, the hooks 28 of bar 27 will be inserted into the recesses and the adjustable stud 28.1 is positioned so that the bar 27 will fit and lift the manhole cover C.1 without difficulty when the plate 24 is applied to the stud 26.

It will be seen that I have provided a new and improved manhole cover lifting device facilitating ready and easy lifting and manipulating of the manhole cover without manually grasping the cover and while allowing a workman to efficiently apply his weight in order to lift the manhole cover and minimize the possibility of personal injury to the workman. The lifting device is readily and easily attached to the manhole cover and merely tilts to lift the cover about the wheels which form the fulcrum and transfer the force to the rigid steel insert bar inside the rather light steel tubing forming the lever 11.

What is claimed is:

1. A manhole cover lifting device comprising an elongate inclined rigid lever having a first lower end with fastener means for attachment to a manhole cover and also having a second upper end with a depending foot thereon to prevent the upper end of the lever and a workman's hands thereon from engaging the ground, and elongate handle affixed on the upper end of the lever and extending transversely thereof at a location in superposed relation with respect to the upper end of the handle, a depending rigid strut affixed to the lever intermediate the ends and having a lower end with means mounting an elongate horizontal axle extending transversely of the strut and of the lever, said axle having a pair of ground engaging wheels thereon providing a fulcrum for the lever, both the lever and the strut being formed of rigid steel tubing and being welded together, an elongate rigid steel insert bar concealed and affixed within the tubing of the rigid lever adjacent the depending strut and extending in both longitudinal directions along the lever from the strut, an elongate lifter bar extending generally along the lever and in oblique relation thereto, one end of the lifter bar being affixed to the lower end of said strut and the other end of the lifter bar being affixed to the lower end of the lever, said lifter bar spanning across a distance approximating one-half the diameter of a manhole cover, and said fastener means including a rigid plate suspended upon a bail, said bail being secured to said first lower end of said lever said plate having an elongate slot through one side thereof to releasably receive an upright stud secured to the manhole cover, and means for securing said stud to the manhole cover, including an elongate rigid bar having a length approximating the diameter of a manhole cover, said stud being affixed to the bar approximately mid-way along the length of the bar, and said bar having a pair of depending hook-like protuberances depending therefrom for engaging recesses in the manhole cover for lifting the cover.

* * * * *

UNITED STATES PATENT AND TRADEMARK OFFICE

CERTIFICATE OF CORRECTION

PATENT NO. : 4,365,925

DATED : December 28, 1982

INVENTOR(S) : Sylvester A. Girtz

It is certified that error appears in the above-identified patent and that said Letters Patent are hereby corrected as shown below:

In column 1, line 61, delete "aparatus" and substitute --apparatus--.

In column 2, line 6, delete "lever" (second occurrence) and substitute --lower--.

In column 2, line 33, delete "therefore" and substitute --thereof--.

Signed and Sealed this

*Twenty-sixth* Day of *April 1983*

[SEAL]

*Attest:*

GERALD J. MOSSINGHOFF

*Attesting Officer*

*Commissioner of Patents and Trademarks*